US005266047A

United States Patent [19]

Black et al.

[11] Patent Number: 5,266,047

[45] Date of Patent: Nov. 30, 1993

[54] ELECTRICAL CONNECTOR ASSEMBLY

[75] Inventors: Teresa K. Black, Etters; David R. Dudukovich, Hummelstown; John C. Farrar, Harrisburg; Robert C. Hosler, Sr., Marysville; Hung T. Nguyen, Harrisburg, all of Pa.

[73] Assignee: The Whitaker Corporation, Wilmington, Del.

[21] Appl. No.: 868,049

[22] Filed: Apr. 13, 1992

[51] Int. Cl.[5] ..... H01R 13/627

[52] U.S. Cl. ..... 439/364; 439/95

[58] Field of Search ..... 439/364, 607, 95, 101, 439/108, 89, 374, 378, 608, 359, 362, 610

[56] References Cited

U.S. PATENT DOCUMENTS

| | | | |
|---|---|---|---|
| 1,722,816 | 7/1929 | Meunier | 439/378 |
| 3,380,141 | 4/1968 | Rofer | 29/203 |
| 3,745,512 | 7/1973 | Johnson et al. | 439/378 |
| 4,483,575 | 11/1984 | Krüger et al. | 439/367 |
| 4,509,258 | 4/1985 | Locati et al. | 439/378 |
| 4,624,517 | 11/1986 | Anhalt et al. | 439/108 |
| 4,699,590 | 10/1987 | Farrar et al. | 439/95 |
| 4,701,004 | 10/1987 | Yohn | 439/871 |
| 4,726,638 | 2/1988 | Farrar et al. | 439/620 |
| 4,729,743 | 3/1988 | Farrar et al. | 439/276 |
| 4,808,118 | 2/1989 | Wilson et al. | 439/95 |
| 4,820,174 | 4/1989 | Farrar et al. | 439/95 |
| 4,874,337 | 10/1989 | Paukovits, Jr. et al. | 439/609 |
| 4,925,404 | 5/1990 | Dutcher | 439/95 |
| 5,007,858 | 4/1991 | Daly et al. | 439/498 |
| 5,062,808 | 11/1991 | Hosler, Sr. | 439/580 |

OTHER PUBLICATIONS

AMP Catalog 73-162, pp. 1 and 3 to 9, Feb. 1990.

U.S. patent application 07/818,188 (Drawings & Abstract).

U.S. patent application 07/818,301 (Drawings & Abstract).

*Primary Examiner*—Larry I. Schwartz

*Assistant Examiner*—Hien D. Vu

*Attorney, Agent, or Firm*—Anton P. Ness

[57] ABSTRACT

An electrical connector assembly 10, and method of assembling, comprising a front electrical connector 12 and a rear electrical connector 23 secured together at a separable interface, the front electrical connector 12 including securing means 19 and guiding means 68 and a rear electrical connector 23 including receiving means 56 and aligning means 74. The securing means is engaged by the receiving means to assemble the electrical connector assembly 10 by drawing the front electrical connector 12 relatively toward the rear electrical connector 23, and the guiding means 68 being engaged by the aligning means 74 to maintain the front electrical connector 12 in a precise spatial relationship with respect to the rear electrical connector 23 during assembly and disassembly. The front entry electrical connector 12 further includes first electrical contacts 14 designed to mate with second electrical contacts 48 of the rear electrical connector 23 at the separable interface, the first electrical contacts 14 being removable through the rearward end 34 of the front electrical connector 12 exposed when the front and rear connectors are separated.

11 Claims, 5 Drawing Sheets

ELECTRICAL CONNECTOR ASSEMBLY

FIELD OF THE INVENTION

The present invention relates to the field of electrical connectors, and more particularly to connectors having a plurality of terminals insulatively housed within a conductive shell and having circuit-protective components.

BACKGROUND OF THE INVENTION

The present invention relates to high-density, multiple-contact connectors which are used in a variety of applications. For example, in aircraft, such connectors are often used to interface various locations throughout the aircraft with processing circuitry located within an enclosure or black box in the electronics bay bulkhead of the aircraft.

For convenience and flexibility, it is known to manufacture such connectors in the form of modular assemblies in which one or more connector modules or "modules" are supported within an outer shell member. Both the outer shell member and the modules are manufactured in a variety of standard configurations. In order to form a modular connector assembly suitable for a particular application of interest, the appropriate shell member and modules are selected and mounted within the outer shell member. The module containing electrical connector as a whole is then mounted to a bulkhead or other mounting surface for use, providing a mating face along one side of the bulkhead and an opposed electrical connection interface on the other side.

For even greater flexibility, the modules can be removably mounted within the outer shell member.

Replacement of a particular module requires the removal of the module from the outer shell member and the mounting of a new module in its place. Thus, when a module is damaged, it is not necessary to replace the modular connector assembly as a whole or to interfere with other modules in the modular connector assembly, as the damaged module can be removed and replaced without replacing the remaining modules.

In the industry, it is known to design modules that protect circuitry from disruptions caused by electromagnetic interference ("EMI"), including radio frequency interference ("RFI") entering the system In addition to protecting or filtering electronic equipment against EMI/RFI energy, there is also a need to protect the equipment against power surges or suppress transients owing to electrostatic discharges ("ESD") and electromagnetic pulses ("EMP"). The high voltage generated by ESD and EMP can damage voltage sensitive integrated circuits and the like.

Frequently today's electronic circuitry requires the use of high density, multiple contact electrical assemblies. As the newer generation of electronic circuits are increasingly packed into smaller spaces, the circuits become more susceptible to damage from the above types of energy. There are many applications in which it is desirable to provide an assembly with a filter capability; for example, to suppress EMI and RFI, and transient suppression means to suppress EMP and ESD interference or other undesired signals which may exist in circuits connected by the assemblies.

Typical of the prior art describing filter modules are U.S. Pat. Nos. 4,820,174 ("'174 Patent") and 4,699,590 which shows one or more filter modules positioned within an outer conductive shell. Typical of the prior art describing transient suppression modules is U.S. Pat. No. 4,726,638 which shows a transient suppression system for protecting individual circuit boards. Typical of the prior art including both filter and transient suppression protection is U.S. Pat. No. 4,729,743 ("'743 patent") assigned to the assignee of the present invention. The connector assembly described in the '743 patent includes both filter and transient suppression modules mounted within an outer shell member. Grounding paths are provided automatically from the transient and filter modules to the outer shell member by first spring fingers engaged around each filter circuit contact assembly and a plurality of second spring fingers engaged to the conductive outer shell. These modules are especially useful in the high density, multiple contact electrical assemblies of today, which circuits are susceptible to the above types of energy In prior art connectors, it has been known to utilize the modular connectors described above for this purpose, wherein discrete modules providing protective circuitry are assembled within a sleeve. A problem in the prior art has been effecting proper alignment of the electrical contacts during mounting For example, in high density electrical contact modules, the electrical contacts can be very fragile, and easily damaged if the mating units are not precisely aligned during mounting and subsequent use. Further, slight alignment errors can result in the electrical contacts being arc welded as a result of the high voltages these modules are subject to. In the prior art, ensuring proper alignment has been effected by the use of specialized tools, or prefabricating the modular units into an electrical connector prior to its intended destination.

A particular problem has been the difficulty in replacement of damaged electrical contacts in such a modular unit. During manufacture or use of the connector, one or a few of the contacts may become damaged or broken and require repair or replacement.

In general, many prior art devices require removal and replacement of the module containing the damaged electrical contacts. Because a connector insert may contain as many as 150 separate contacts, replacement of the entire module and all of its associated electrical contacts can be relatively costly. Moreover, if the modular elements are soldered or otherwise permanently attached together or to the sleeve, it is necessary to replace the entire connector and all of the electrical contacts therein in order to overcome the problem of a single damaged contact. For example, U.S. Pat. application Ser. No. 07/818,188, entitled "Modular EMP and EMI Connector Assembly," by Nguyen, filed on Jan. 8, 1992 illustrates full modular replacement, rather than replacement of individual contacts, by using a tool such as disclosed in U. S. patent application Ser. No. 07/818,301 also filed Jan. 8, 1992. Also, due to the availability and cost of the connectors and modular units, it is not always possible to find a replacement module at the site where damage is discovered, causing delays in repair.

Thus, the inability to effect the proper mounting and removal of circuit modules without damaging the electrical contacts therein, and without the use of specialized tools has presented a problem. Further, replacement of damaged electrical contacts in modular and other high density electrical connectors has required the costly replacement of the entire connector or module as a result of damage to one or several relatively inexpensive electrical contacts.

Further still, it has not been possible in many circumstances to repair damaged electrical contacts at the site the damage occurs or is detected. In such cases, repair requires the removal and replacement of the module or connector containing the damaged contact, and the entire unit then being sent to another location to repair the damaged contact. On-site repair has not been possible. This problem has been compounded by frequent unavailability of replacement modules and connectors in non-metropolitan locations, causing further delay in repair.

None of the of the prior art devices described above provide a modular connector assembly having improved assembly characteristics such that they can be installed properly and without damage, using readily available conventional or simple hand tools and without the use of any specialized tools. Nor do any of the above described devices have replacement capabilities such that a damaged electrical connector unit may be replaced by simply and inexpensively replacing the damaged electrical contact, without replacing the entire connector or module unit. Nor do any of the above described devices have the capability of on-site repair through simple replacement of the damaged electrical contact, which contacts are generally widely available.

It is desired to provide separable connector portions having respective shells therearound, securable together at a separable interface and separable thereafter, permitting access to at least the inside face of one of the two connector portions for inserting tools into contact passageways for contact removal from the now exposed inside face and assuring shielding continuity between the shell portions.

SUMMARY OF THE INVENTION

It is an object of the present invention to overcome these problems by providing an electrical connector assembly having both improved and simplified mounting and replacement capability, inexpensively through the replacement solely of a contact damaged at the mating face rather than by replacing the entire module or connector, and inexpensively through replacement of a modular subassembly containing EMP-protecting components or filter components rather than by replacing the entire connector.

It is still a further object of the present invention to provide an electrical connector wherein damaged electrical contacts can be repaired at the site of the connector, without using novel specialized tools, and without replacing the entire module or connector.

It is also an objective to provide for such repair and contact replacement for a connector having triax connecting means, either solely or with other non-triax contacts.

According to the present invention, an electrical connector assembly is provided which allows access to included electrical contacts comprising a front electrical connector and a rear electrical connector, securable together at a separable interface. The front electrical connector includes a conductive front shell therearound and has an array of axially extending passages therethrough from a mating face to an opposing rearward end adapted to receive thereinto a first electrical contact from the rearward end, the first electrical contact fixedly secured in the front electrical connector. The front electrical connector further defines securing means and guiding means.

The rear electrical connector includes a conductive rear shell therearound and has an array of axially extending passages therethrough each having a second electrical contact secured therein disposed to mate with an associated first electrical contact at the separable interface and extending to an electrical connection interface at the rearward end of the rear. The rear electrical connector defines receiving means disposed to engage the securing means, and aligning means disposed to engage the guiding means.

The rear electrical connector is secured to the rearward end of the front electrical connector at the separable interface by the securing means being engaged by the receiving means, and the guiding means engaging the aligning means to draw the rear electrical connector toward the front electrical connector to mate rearward contact sections of the first electrical contacts with forward contact sections of the second electrical contacts while maintaining a precise spatial relationship between the front and rear electrical connectors.

Preferably, the front electrical connector includes the first electrical contacts within a module, the module being removably inserted into the front shell, and the electrical contacts being removable from the rearward end of the front electrical connector. Additionally, the second electrical contacts may be fixed in a dielectric body within a sleeve, the sleeve forming a male insert for a female receptacle formed within the rear shell, and being removable therefrom. Also preferably, the securing means comprises the male end of a jackscrew and the receiving means of the female end of a jackscrew, and the guiding means comprises a guide pin and the aligning means an aperture disposed to engage the guide pin.

As pointed out in greater detail below, this invention provides the important advantages of a simply installed electrical connector which can be installed without the use of any specialized tools. The electrical connectors according to the present invention also have the advantage of allowing repair of a damaged electrical contact or contacts without the replacement of the entire module or connector, and further allows that repair be effected at the site that the electrical connector is installed, by simply replacing the damaged contact.

The invention itself, together with further objects and attendant advantages, will best be understood by way of example with reference to the following detailed description taken in conjunction with the accompanying drawings.

DETAILED DESCRIPTION OF THE INVENTION

Figure 1:
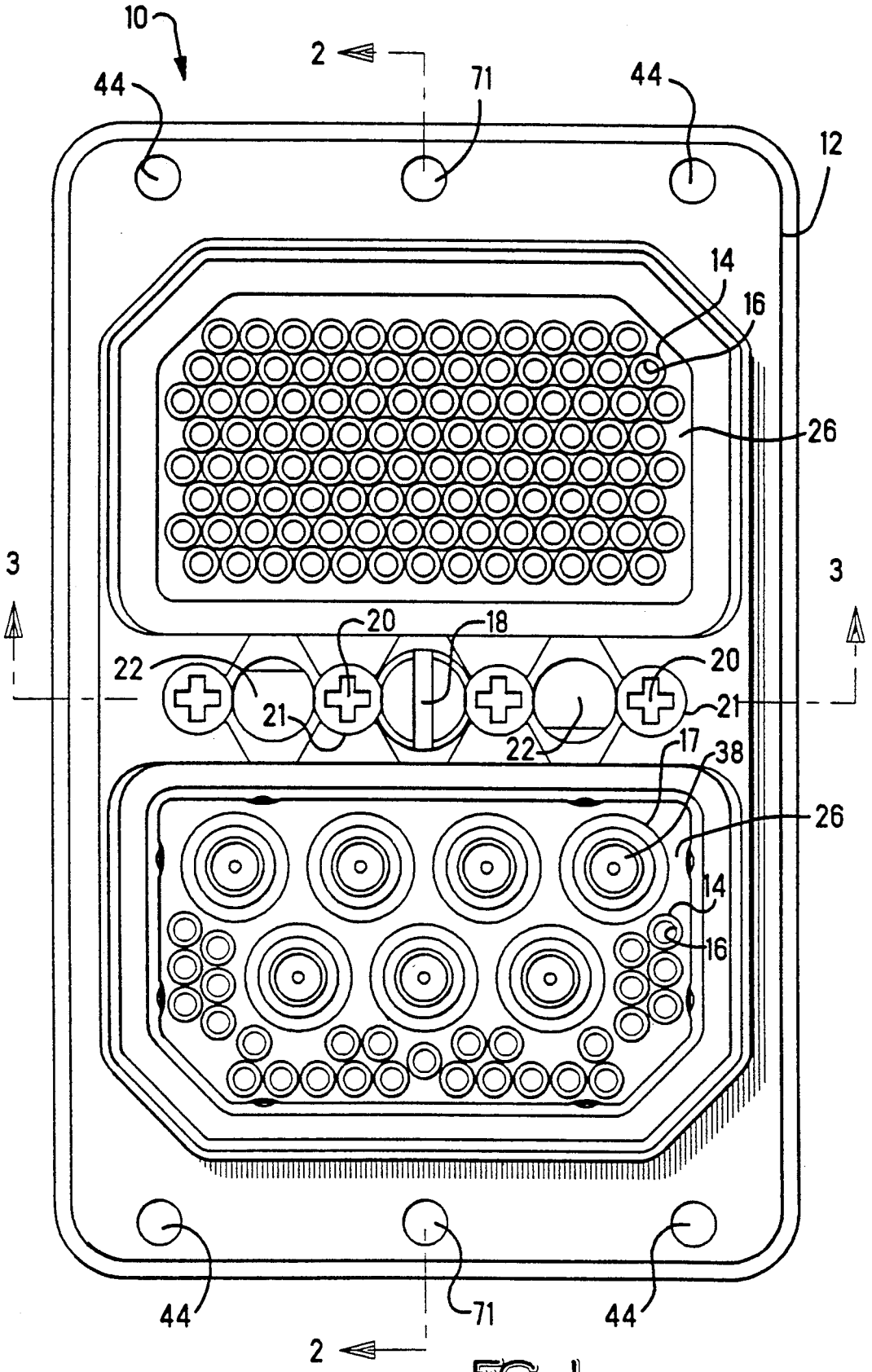
FIG. 1 is a front end View of the electrical connector assembly according to the present invention.
Figure 2:
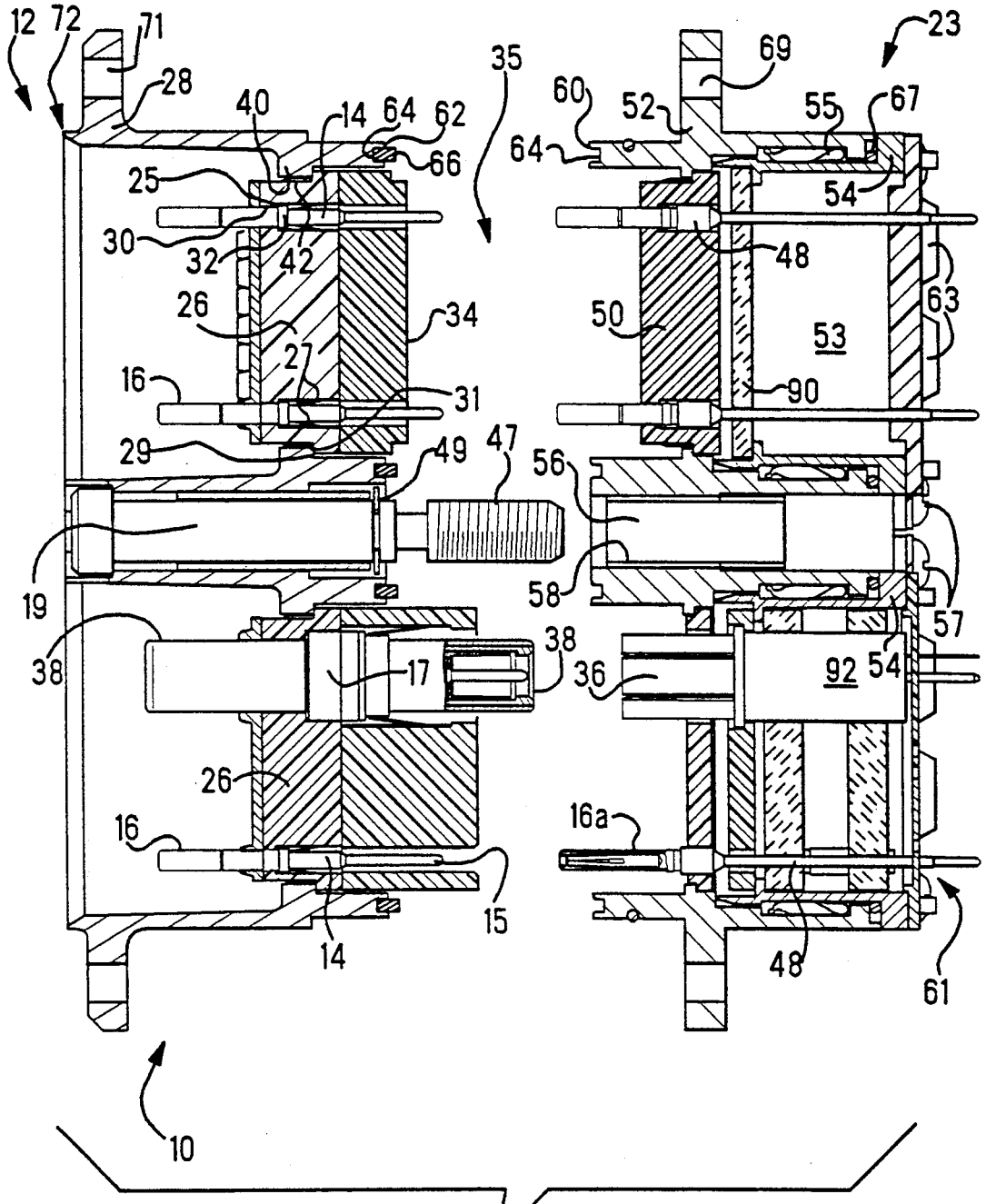
FIG. 2 is an exploded cross sectional view of the electrical connector assembly according to the present invention taken along line 2—2 of FIG. 1 showing the front and rear electrical connectors.

Turning now to FIG. 1, an end view of the electrical connector assembly 10 and the front electrical connector 12, as shown in FIG. 2, is illustrated comprising first electrical contacts 14 exposed across the mating face of the connector for mating with complementary contacts of a mating connector (not shown). First contacts 14 are shown having socket contact sections 16 at the mating face; also shown are male receptacle sections 38 of first triax connecting means such as triax connector adapters 17 of the type disclosed in U. S. Pat. No. 5,062,808 issued to Hosler, Sr.

Also shown in FIG. 1 is the screw head or actuator 18 of the male jackscrew 19 and the screw heads 20 of the screws 21. FIG. 1 further shows keys 22 for physically ensuring that mating with a mating electrical connector (not shown) at the forward end or mating face 72, only occurs with the appropriate one of several mating connectors having appropriate complementary keying.

Turning to FIG. 2, a cross sectional view of an unassembled electrical connector assembly 10 according to a preferred embodiment of the present invention is illustrated. The electrical connector assembly 10 comprises a front electrical connector 12 and a rear electrical connector 23 opposing each other at a separable interface 35, and which upon full assembly extends from the mating face 72 defined by front connector 12 to an electrical connection interface defined by rear connector 23 at rearward end 61.

As shown in FIG. 2, the front electrical connector 12 comprises a representative first electrical contact 14 secured, in a module 26 which is situated in a front shell 28, module 26 having an axially extending passage 30 therethrough in which is secured the first electrical contact 14. The first electrical contact 14 comprises a shoulder 32 which is disposed in the module 26 against a bearing surface 25 defined along the passage 30 of module 26 in such a way that the first electrical contact 14 can only be removed from the module 26 through the rearward end 34 of the front electrical connector 12. Retaining fingers 27 of a retention clip secured in passage 30 of the module, shoulder 32 to bear against bearing surface 25 of the module 26. Such rear-release contact terminals and an extraction tool therefor are described in U.S. Pat. No. 3,380,141, entitled "Contact Terminal Extraction Tool," issued to David Rofer on Apr. 30, 1968, and U.S. Pat. No. 4,701,004, entitled "Retention Clip For Electrical Contacts," issued to Brent D. Yohn, on Oct. 20, 1987.

The module 26 is removably secured to the front shell 28 by means of module securing means (not shown), and comprises a plurality of first electrical contacts 14 therein. The module is further fastened to the front shell 28 at a module engaging surface 40, at the point of contact between the front shell 28 and the module 26, by module securing means, such as epoxy resin 42. An inner shoulder 29 on the front shell bears against a module shoulder 31 to prevent the module 26 from exiting the front of the front shell 28.

The front shell 28 further comprises mounting means 44 (FIG. 5) for mounting the front electrical connector 12, for example, in a cutout of a side wall of an electronics control unit or black box (not shown), or in a panel or a wall such as an aircraft bulkhead by screws or the like, with its mating face 72 exposed outwardly for mating to a mating connector.

The securing means such as a male jackscrew 19 is elongate and extends axially rearwardly from the front electrical connector 12 along separable interface 35 includes an engagement section, such as a threaded surface 47, by which the male jackscrew 19 can be incrementally engaged or disengaged from a female jackscrew counterpart. The male jackscrew 19 is retained in the front electrical connector 12 by a retaining ring 49 which allows the male jackscrew 19 to rotate freely within a sleeve which maintains it in an angularly stable orientation during actuation.

As further shown in FIG. 2, the rear electrical connector 23 comprises a representative second electrical contact 48 fixedly attached within a socket insert 50, which is mounted inside a rear shell 52 at solder joints 51, as well as a representative second triax connecting means such as triax connector 92. The rear shell 52 includes a large axially extending passage 53. A forward contact section such as a socket section **16*a* of the second electrical contact 48, one of which is shown in section, is disposed to mate with a rearward contact section such as a complementary pin section 15 of the first electrical contact 14 of the front electrical connector 12. Triax connector 92 includes a female forward section 36 matable with male rearward section 38 of triax adapter 17 of front electrical connector 12**.

Triax adapters 17 are secured within respective triax cavities by retention clips having forwardly and radially inwardly extending lances which latch behind a collar of the outer surface of the adapter. The adapter is stopped against forward motion by a ledge of the cavity and against rearward movement by the clip abutting a forwardly facing ledge near the rearward cavity end. The rearward end of the cavity is enlarged, and the rearward clip end is radially spaced from the outer surface of the triax adapter, all to permit receipt of the outer conductor of the female contact section of triax connector 92 during mating and also permit receipt of a tool work end (not shown) to deflect the clip lances outwardly for triax adapter removal. The module containing the triax adapters extends rearwardly of the rearward shell end to protect the somewhat elongate triax adapters and to contain the retention clips, also serving as a polarizing indicator. Rear connector 23 is complementarily shaped to interfit with the extended portion of the module of the front connector 12.

The second electrical contacts 48 in FIG. 2 are affixed in a dielectric insert means of a subassembly within a conductive sleeve 54, the sleeve 54 being replaceably mounted within the axially extending passageway 53 of the rear shell 52 by sleeve securing means, such as screws, 57. The rear shell 52 further contacts the sleeve 54 via a ground spring 55 which acts to ground the sleeve 54 for EMI and other protection described above.

Receiving means, such as a female jackscrew 56 of the rear entry electrical connector 23 are disposed along separable interface 35 to engage with the male jackscrew 19 at a threaded surface 58. The female jackscrew 56 is mounted to the rear shell 52 by screws 59 in FIG. 3.

Offsets 63 as shown on the rearward end or electrical connection interface 61 of the rear electrical connector 23 ensure proper mounting of the electrical connector assembly 10 to an external electrical medium (not shown) such as circuit board in a manner providing for conventional cleaning of flux after reflow soldering procedures.

Referring to FIG. 2, a rear shell load bearing surface contact 60 is shown which contacts a corresponding front shell contact point 62 upon assembly of the electrical connector assembly 10. The front shell load bearing surface or contact point 62 further comprises an EMI gasket bearing surface 64 preferably having a groove cooperable with an opposing groove 64 the rear shell load bearing surface 60 to define a seat within which rests an EMI gasket 66 such as a ring of conductive elastomer secured in one of the grooves such as by conductive epoxy. The EMI gasket 66 ensures complete conductive engagement or shielding therearound at the incremental gap between the rear and front shells peripherally therearound, and is designed to protect the circuitry in the electrical connector assembly 10 from electromagnetic interference which can damage such circuitry.

An EMI gasket 67 is also placed at a contact point 65 between the rear sleeve 54 and the rear shell 52. FIG. 2 depicts first and second contacts 14,48 having complementary pin contact sections 15 and socket contact sections 16 and such as are suitable for transmission of low-pass filtered signals, and high integrity signals via triaxial arrangements of triax adapters 17 and triax connectors 92 with mating sections 36,38 facing each other in the rear 23 and front 12 electrical connectors.

Figure 3:
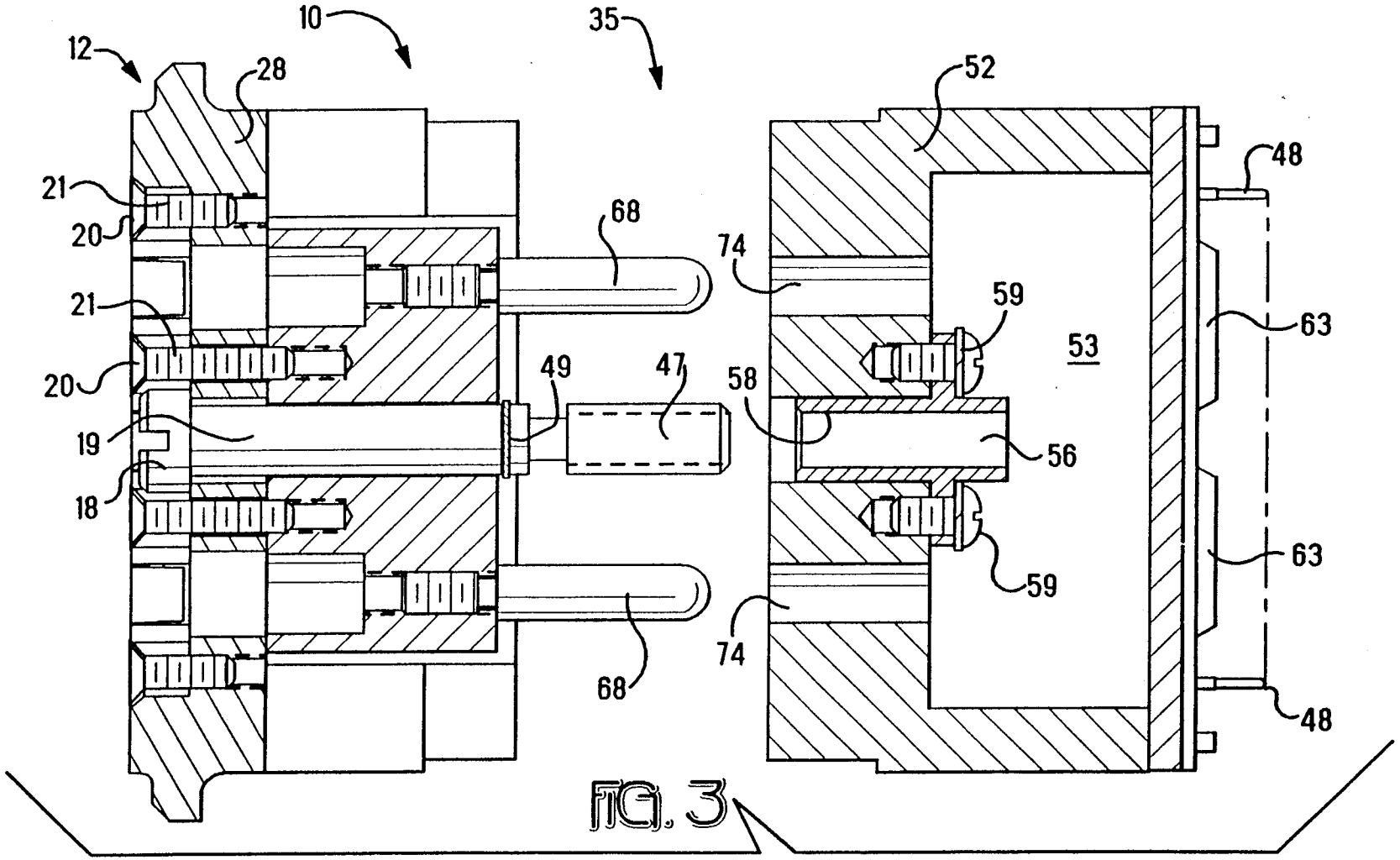
FIG. 3 is an exploded cross sectional view of the electrical connector assembly according to the present invention taken along line 3—3 of FIG. 1 showing the guiding and aligning means.

Turning to FIG. 3, further elements of a presently preferred embodiment of the present invention are shown. The front electrical connector 12, comprising the front shell 28, module 26 (FIG. 2) and male jackscrew 19, is further defined by guiding means such as guide pins 68. Guiding means can comprise a pair of robust posts 68 spaced from jackscrew 19, having alignment sections extending axially rearwardly from front connector 12 and secured to front shell 28 by threaded shanks in threaded shell apertures in a manner which assures precise positioning and angular stability of the alignment sections during connector securing.

The rear electrical connector 23 further comprises aligning means, such as receptacle portions 74 disposed to snugly receive the alignment sections of guide pins 68 in the front electrical connector 12 initially engaging prior to any mating of first and second contacts and first and second triax connecting means. This ensures a precise spatial relationship is maintained between the front electrical connector 12 and the rear electrical connector 23 upon assembly of the electrical connector assembly 10, as described below.

Also shown in FIG. 3 is the male jackscrew 19, with a screw head actuator 18 disposed on the frontward end of the male jackscrew 19 accessibly positioned on or near the mating face 72 of the front electrical connector 12 for tool engagement. The male jackscrew 19 is disposed to engage the female jackscrew 56 of the rear electrical connector 23 so as to secure the front electrical connector 12 to the rear electrical connector 23 in the assembled electrical connector assembly 10. Second electrical contacts 48 include rearward pin contact sections extending from the rearward end or electrical connection interface 61 of the rear electrical connector 23.

Figure 4:
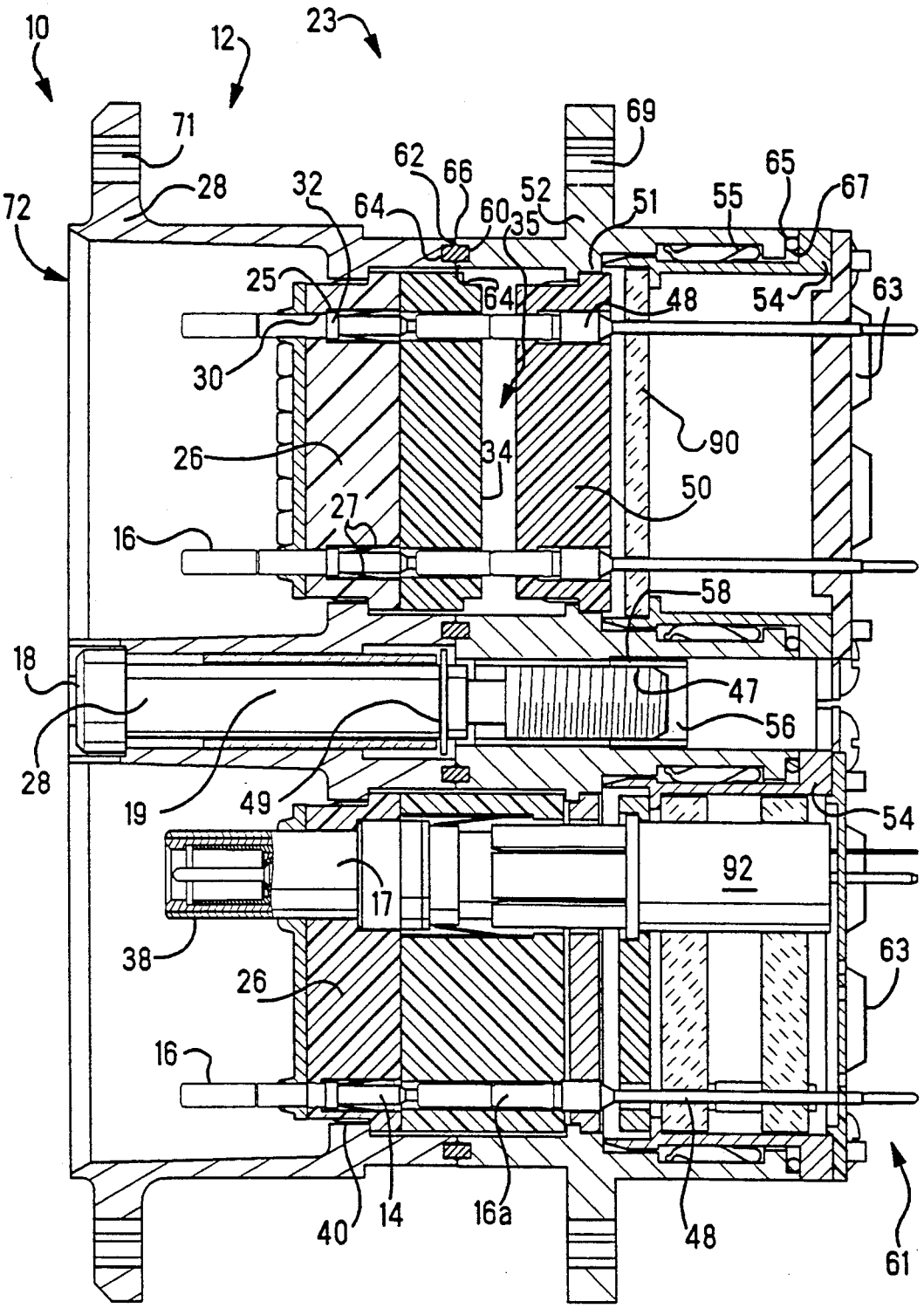
FIG. 4 is a cross sectional view of the assembled electrical connector assembly of FIG. 2.

Turning to FIG. 4, a front electrical connector 12 and rear electrical connector 23, as shown in FIG. 2, are shown assembled into an electrical connector assembly 10. The male jackscrew 19 is shown engaged with the female jackscrew 56 at their threaded surfaces 47,58. The front and rear electrical connectors 12,23 are engaged together by turning the screw head 18 of the male jackscrew 19 with an appropriate driver, generally a conventional or simple hand tool such as a screw driver, hex wrench, socket wrench or the like.

As shown in FIG. 4, in the assembled electrical connector 10 the first electrical contact 14 is mated with the second electrical contact 48 via complementary pin and socket contact sections **15,16*a*, and the triax adapter 17 is mated with triax connector 92 via complementary male and female connector sections 36,38. At the contact point 60,62 between the front electrical connector 12 and the rear electrical connector 23, an EMI gasket bearing surface 64 is shown, with an EMI gasket 66** fitted therein.

Figure 5:
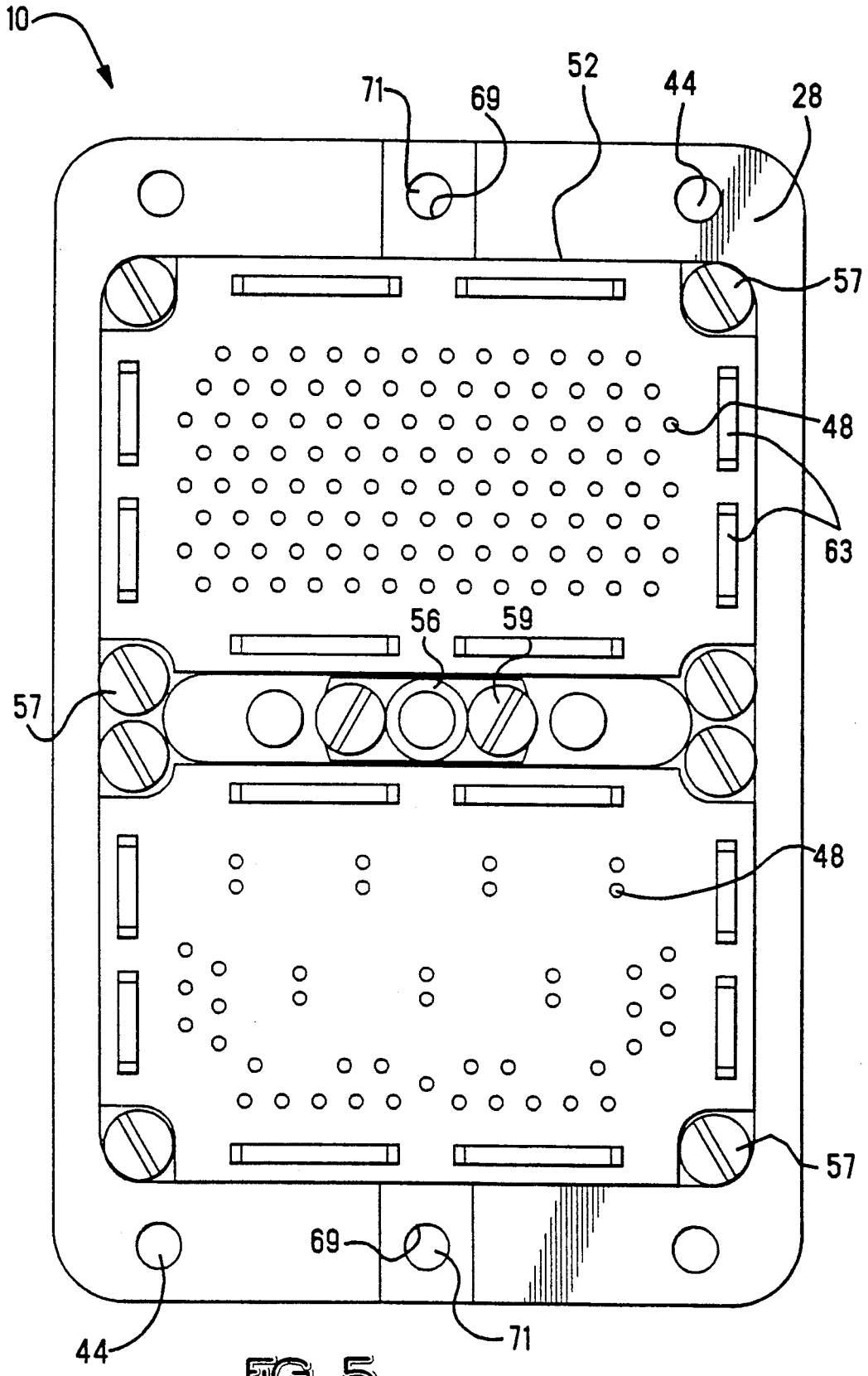
FIG. 5 is an end view of the rear electrical connector according to the present invention.

FIG. 5 shows a rearward end view of the electrical connector assembly 10 and the rear electrical connector 23 according to FIG. 2. FIG. 5 also shows sleeve securing means such as screw heads 57 which secure the sleeve 54 to the rear shell 52. Attaching means, such as a bolt, or spring clip (not shown), may secure the front electrical connector 12 via aperture 71 to the rear electrical connector 23 via aperture 69 after assembly of the electrical connector assembly 10.

The electrical connector assembly 10 of the present invention is assembled in the following manner. As shown in FIGS. 1, 2 and 3, the threads 47 of the male jackscrew 19 of the front electrical connector 12 are engaged with the threads 58 of the female jackscrew 56, and turned in the appropriate direction to incrementally draw the rear electrical connector 23 toward the front electrical connector 12 at separable interface 35 to mate the electrical contacts 14 with the second electrical contacts 48, and triax adapters 17 with triax connectors 92. Contemporaneously with the engaging of the male jackscrew 19 with the female jackscrew 56, the guide pins 68 of the front electrical connector 12 are engaged by being inserted into the aperture 74 forming the aligning means in the rear electrical connector 23. The combined effect of the male jackscrew 19 being inserted into the female jackscrew 56 and the guide pins 68 being inserted into the apertures 74 brings the first electrical contacts 14 together with the second electrical contacts 48, and triax adapters 17 with triax connectors 92, all mating to form electrical connections.

Also, by way of the combined effect of the male jackscrew 19 engaging the female jackscrew 56 and the guide pins 68 engaging the apertures 74, the rear electrical connector 23 is brought toward the front electrical connector 12 in a precise spatial relationship, ensuring that the electrical contacts 14,48 and triax adapters 17 and connectors 92 are not damaged during insertion.

Replacement of a damaged or faulty electrical contact in the electrical connector assembly 10 according to the present invention is greatly simplified and proceeds in the following manner. The assembled electrical connector 10 shown in FIG. 4 is disassembled by turning the screw head 18 to incrementally disengage the male jackscrew 19 from the female jackscrew 56. Contemporaneously, the guide pins 68 are disengaged from the corresponding apertures 74. The combined action of the male jackscrew 19 disengaging the female jackscrew 56 and the guide pin 68 disengaging the aperture 74 ensure that while the front electrical connector 12 and the rear electrical connector 23 are being separated at separable interface 35, respective connectors 12,23 are maintained in a precise spatial relationship. Also, the alignment of the electrical contacts 14,48 is preserved during disassembly preventing damage thereto.

Once apart, the damaged electrical contact is identified and removed by use of a suitable tool. Merely by way of example, a tool for extracting on electrical contact such as that illustrated in U.S. Pat. No. 3,380,141, describing a tool for extracting an electrical contact terminal with a locking tang retainer which description is herein incorporated by reference, may be used to extract the damaged electrical contacts. Where the damaged contact is a first contact 14 in the front electrical connector 12, the damaged electrical contact is removed by using an appropriate extraction tool and the electrical contact 14 toward the now-exposed rearward end 34 of the front electrical connector 12 until fully dislodged. This electrical contact is then replaced by an undamaged electrical contact, and the entire apparatus reassembled as described above.

For illustration purposes, it is known that the contact sections of the electrical contacts on the front or mating faces of mating connectors, such as corresponding to the frontward end or mating face 72 of the presently described front electrical connector 12, are most often damaged due to frequent connection with and disconnection from other external electrical contacts of a mating connector (not shown) and are also exposed and thus vulnerable to damage when unmated. For this reason, the preferred embodiment of the present invention envisions the use of an electrical contact module 26 with removable first electrical contacts 14 therein, for the front electrical connector 12, while the second electrical contacts 48 of the rear electrical connector 23 are permanently mounted therein. According to this embodiment, the second electrical contacts 48 are affixed to socket inserts 50 in a sleeve 54. the sleeve 54 being secured to the rear shell 52 and grounded via a ground spring 55.

Variations of the embodiments described above are possible. For example, the securing means 19 can be any art recognized method for repeatably incrementally fastening two units together with precision, for example, a nut and bolt arrangement, or a ratchet and pawl arrangement or other means providing for incremental, precise, axial motion.

In another variation, guiding means according to the present invention can comprise any structure that is capable of forming a guide for the joinder of the front and rear entry electrical connectors in a precise manner.

In yet another variation, it is also within the scope of the present invention to include electrical contact modules with removable electrical contacts in the rear electrical connector. By way of example, it is contemplated that the second electrical contacts be included in a sleeve, which sleeve is fully removable from the rear electrical connector and the rear shell. Thus, the removal of a damaged electrical contact from the rear electrical connector is effected by pulling the sleeve and the included electrical contacts toward the rearward end of the rear electrical connector. Of course, the second electrical contacts in the rear sleeve may optionally be replaceably mounted in the sleeve allowing replacement of the individual damaged electrical contact, or the second electrical contacts may be permanently mounted therein in which case damage to one requires replacement of the entire sleeve.

In still yet another variation, the first electrical contacts in the front electrical connector are preferably in the form of a removable module, the first electrical contacts themselves being removable, because, as indicated above, it is generally the contacts in the front or mating end of the connector which are subject to increased opportunity for damage. The second electrical contacts in the rear electrical connector may also be removable, as in the form of the sleeve, if desired. The modules or sleeves are generally fastened to the respective electrical connector by means of a ground spring or other fastening means which facilitates ease of insertion and removal. The front and rear connectors, according to the invention, may be subject to as much as 40 to 50 lbs or more of force upon securing together without damage to the electrical contacts. However, the first and second electrical contacts may also be secured in the main housing of an electrical connector itself. For example, the first electrical contacts may be removably secured in passages through dielectric material which is integral to the connector unit itself. All that is necessary for the present invention is that the electrical contacts of the front and rear connectors be disengageable upon the separation of the front electrical connector from the rear electrical connector.

In yet another variation, the modules suitable for use in this invention may include over 100 electrical contacts therein. These modules are designed to be useful for various purposes including EMI/RFI protection and EMP/ESD protection. For example, as shown in FIG. 4, EMP protection, as described above, may be similar on a contact assembly 90. Alternatively or additionally, complete EMI shielding may be used for the entire connector.

It is further contemplated that the present invention encompass electrical connector assemblies which include multiply stacked modular inserts in a single axially extending passageway or a plurality of modules placed in a corresponding plurality of axially extending passageways in the front and rear shell, as well as a single module in a single axially extending passageway, each variation capable of assembly and disassembly by using a simple hand tool to engage or disengage a single jackscrew or other securing means, preferably an incremental securing means.

The contacts themselves can be of any structure known in the art to be useful for these types of electrical connectors and which are removable from their mounting. Merely by way of example, U.S. Pat. No. 4,701,004, illustrates a removable electrical contact with a retention clip which would be suitable, which description is herein incorporated by reference. As other examples, contacts having pin or socket contact sections are useful, as are those with a clean profile and no annular rings.

As can be seen, the assembling of the electrical connector according to the present invention requires no specialized tools, but instead may be effected by the use of a conventional or simple hand tool, such as a screw driver, socket wrench, hex driver or the like, such simple hand tools being readily available to a mechanic replacing an electrical contact according to the present invention. This is in contrast to the prior art devices wherein removal of the modules containing the electrical contacts required a specialized tool, and moreover, the removal of the electrical contacts themselves was not generally possible at the site where the damage may occur.

Of course, it should be understood that a wide range of changes and modifications can be made to the preferred embodiment described above. It is therefore intended that the foregoing detailed description be understood that it is the following claims, including all equivalents, which are intended to define the scope of this invention.

We claim:

1. An electrical connector assembly comprising:

a front electrical connector and a rear electrical connector adapted to be assembled to each other at a separable interface, and at least said front electrical connector having a mating face for mating with a corresponding electrical connector remote from said separable interface, and said rear electrical connector having an electrical connection interface remote from said separable interface;

said front electrical connector including a front shell and at least one dielectric insert therewithin, said at least one dielectric insert having at least one axially extending passage therethrough from said mating face to an opposed rearward end along said separable interface, each said at least one passage adapted to receive and secure therein a corresponding at least one first electrical contact, each said first electrical contact being disposed in a respective said passage and including a forward contact section exposed along said mating face for mating with a corresponding conductor of a mating connector, and a rearward contact section exposed along said separable interface;

said front electrical connector further defining securing means and guiding means, at least said securing means being elongate and including an engagement section extending rearwardly from said separable interface and being retained in said front connector in a manner permitting actuation while being maintained in an angularly stable orientation during actuation, and said guiding means secured to said front shell along said separable interface in a manner assuredly maintaining precise positioning and angular stability during securing of said rear connector to said front connector;

said rear electrical connector including a rear shell and at least one dielectric insert therewithin, said at least one dielectric insert having at least one second electrical contact extending therethrough and each said second electrical contact having a rearward portion exposed along said electrical connection interface for electrical interconnection with a corresponding conductor of another electrical article, said second electrical contact further including a forward contact section disposed to mate with said rearward contact section of a respective said first electrical contact along said separable interface;

said rear electrical connector defining receiving means disposed to engage with said engagement section of said securing means along said separable interface prior to mating of any of said first and second contacts, and aligning means disposed to engage with said guiding means along said separable interface and adapted to initially engage therewith prior to mating of any of said first and second contacts, whereby said rear electrical connector is secured to the front electrical connector at said separable interface by said securing means being engaged by said receiving means and said guiding means being engaged by said aligning means to draw the rear electrical connector toward the front electrical connector to mate said at least one first electrical contact with said at least one second electrical contact, all in a manner permitting separation of the front and rear electrical connectors while assuredly maintaining a precise spatial relationship therebetween during securing and separation.

2. The electrical connector assembly according to claim 1, wherein said front electrical connector securing means comprises a male jackscrew and said rear electrical connector engaging means comprises a female jackscrew, said male jackscrew having an actuator section accessible along said mating face.

3. The electrical connector assembly according to claim 1, wherein said rear electrical connector additionally includes a conductive sleeve therearound adapted to be received insertably into said rear shell and means retaining said sleeve therein, said sleeve grounded to said rear shell via a ground spring.

4. The electrical connector assembly according to claim 1, wherein said front electrical connector includes a plurality of said passages containing a respective plurality of said first electrical contacts, at least one of said plurality of first electrical contacts being removable from rearward of said front electrical connector.

5. The electrical connector assembly according to claim 4, wherein said rear electrical connector additionally includes a conductive sleeve comprising a corresponding plurality of said second electrical contacts, said plurality of second electrical contacts secured in a dielectric body within said sleeve and disposed to mate with respective ones of said plurality of first electrical contacts in said front electrical connector, said sleeve being removably secured to said rear shell and electrically grounded thereto.

6. The electrical connector assembly according to claim 5, wherein said front electrical connector includes a module containing said first electrical contacts and further includes a module engaging surface defined thereon to removably secure said module to said front shell, and said rear electrical connector includes sleeve securing means defined thereon to removably secure said sleeve to said rear shell.

7. The electrical connector assembly according to claim 6, wherein said sleeve removably secured to said rear connector includes circuit-protecting components defining protective circuitry circuit-protecting components defining, and said rear connector protective circuitry is grounded to said rear shell.

8. The electrical connector assembly according to claim 6, wherein said second electrical contacts are low pass filtered electrical contacts.

9. The electrical connector assembly according to claim 1, wherein said front connector includes at least one first triax connecting means having front and rear mating sections, said rear connector includes a corresponding at least one second triax connecting means having front and rear mating sections with said front mating section of each said second triax connecting means being matable with said rear mating section of the corresponding said first triax connecting means, and said front connector includes means housing said first triax connecting means in a respective triax cavity thereof, a portion of said housing mans extending rearwardly of said rearward end of said front shell for cooperating with means within said triax cavity for removably retaining said first triax connecting means against rearward movement in a manner permitting disengagement of said retention means from said first triax connecting means by tool means received from said rearward end of said front connector, rearward portions of said triax cavity and said retention means being radially spaced outwardly from an outer surface of said rear mating section of said first triax connecting means enabling receipt of an outer conductor of said front mating section of said second triax connecting means to surround a length of an outer conductor of said rear mating section of said first triax connecting means and electrically engage therewith inwardly from an end thereof, and said rear electrical connector being adapted to interfit with said rearwardly extending portion of said housing means.

10. The electrical connector assembly according to claim 1, further comprising a load bearing surface on said front shell and a corresponding load bearing surface on said rear shell that abut upon assembly, and said load bearing surfaces being adapted to seat an EMI gasket continuously therealong to comprise an effective continuous EMI shield at said load bearing surfaces.

11. The electrical connector assembly according to claim 1, wherein said guide means comprise a pair of robust post sections extending rearwardly of said rearward end of said front electrical connector to be received in receptacle portions of said aligning means of said rear connector, and said guide means include threaded shanks extending into threaded apertures into a central body portion of said front shell spaced from said securing means on opposing sides thereof.

* * * * *